United States Patent [19]

Fry et al.

[11] Patent Number: 4,846,635

[45] Date of Patent: Jul. 11, 1989

[54] HERMETIC COMPRESSOR MOUNTING PIN

[75] Inventors: Emanuel D. Fry, Tecumseh; Edwin L. Gannaway, Adrian, both of Mich.

[73] Assignee: Tecumseh Products Company, Tecumseh, Mich.

[21] Appl. No.: 147,692

[22] Filed: Jan. 25, 1988

[51] Int. Cl.[4] ..... F04B 35/04; F04B 39/00

[52] U.S. Cl. ..... 417/410; 417/902

[58] Field of Search ..... 417/360, 423 L, 423 T, 417/410, 902, 424 R, 424 A; 62/508; 418/63; 310/42, 91, 258

[56] References Cited

U.S. PATENT DOCUMENTS

| | | | |
|---|---|---|---|
| 1,527,162 | 2/1975 | Alvord | 310/42 |
| 2,130,276 | 9/1938 | Hornaday | 417/902 X |
| 2,178,811 | 11/1939 | Sateren | 417/363 |
| 2,312,514 | 3/1943 | Zimmerer | 417/410 X |
| 2,369,282 | 2/1945 | Curtis et al. | 417/360 X |
| 2,439,241 | 4/1948 | Curtis | 417/350 |
| 2,465,554 | 3/1949 | Roy | 417/415 X |
| 2,517,367 | 8/1950 | Winkler | 417/271 |
| 2,575,889 | 11/1951 | Oulianoff | 60/39.32 |
| 2,610,993 | 9/1952 | Stark | 310/42 |
| 2,612,843 | 10/1952 | Gruetjen | 415/196 X |
| 2,630,964 | 3/1953 | Scheldorf | 417/415 |
| 2,786,624 | 3/1957 | Cole | 417/360 |
| 3,127,092 | 3/1964 | Shenberger | 417/353 |
| 3,162,360 | 12/1964 | Privon et al. | 417/902 X |
| 3,185,099 | 5/1965 | Spring | 417/363 |
| 3,539,272 | 11/1970 | Howard | 415/168 |
| 3,568,712 | 3/1971 | Rinehart | 137/525.3 |
| 3,853,430 | 12/1974 | O'Rourke | 417/360 |
| 3,870,440 | 3/1975 | Zuercher, Jr. | 418/248 |
| 4,134,036 | 1/1979 | Curtiss | 310/42 |
| 4,137,014 | 1/1979 | Parker | 417/326 |
| 4,201,519 | 5/1980 | Niedermeyer | 417/38 |
| 4,399,669 | 8/1983 | Jacobs | 62/508 X |
| 4,470,772 | 9/1984 | Gannaway | 417/368 |
| 4,526,522 | 7/1985 | Onoda | 417/902 X |
| 4,547,131 | 10/1985 | Riffe et al. | 417/53 |
| 4,601,644 | 7/1986 | Gannaway | 417/363 |

*Primary Examiner*—Carlton R. Croyle
*Assistant Examiner*—Leonard P. Walnoha
*Attorney, Agent, or Firm*—Albert L. Jeffers; David L. Ahlersmeyer

[57] ABSTRACT

A hermetic compressor assembly is disclosed including a compressor mechanism and an electric drive motor within a hermetically sealed housing. The electric motor includes a rotatable rotor and a stator. In one disclosed embodiment, the stator is friction fit within the housing and a rotor is press fit over a crankshaft journalled in a crankcase of the compressor mechanism. The crankcase is selectively positioned within the housing and mounted thereto by means of mounting pins. In another disclosed embodiment, the motor is mounted to the compressor mechanism and the compressor crankcase is axially supported in the housing. A mounting pin is used to prevent rotation of the compressor mechanism within the housing caused by torque forces produced by dynamic operation of the motor. The disclosed mounting pins are received within holes in the crankcase and extend radially outwardly through oversized apertures in the housing. The pins are selectively positioned in the apertures prior to welding. A method of assembling a compressor having mounting pins is also disclosed.

23 Claims, 5 Drawing Sheets

HERMETIC COMPRESSOR MOUNTING PIN

BACKGROUND OF THE INVENTION

The present invention relates generally to a hermetic compressor assembly and, more particularly, to such a compressor assembly having a compressor mechanism mounted in a hermetically sealed housing, wherein it is desired to mount the compressor mechanism to provide an air gap between the rotor and stator components of the compressor motor, and to prevent relative movement between the compressor mechanism and the housing due to torque forces produced by the motor.

A typical hermetic compressor assembly comprises a compressor mechanism and an electric motor situated within a hermetically sealed housing. The electric motor comprises a stator member and a rotatable rotor operably spaced from the stator by an annular air gap. Where the compressor mechanism is a rotary compressor, a cylinder block or main bearing flange is circumferentially mounted to the inside wall of the housing and a crankshaft is journalled in bearings on opposite sides of the cylinder block. One end of the crankshaft is press fit into the center of the rotor which, in turn, is spaced from the stator. In the case of the rotary compressor, the motor stator is circumferentially friction fit against the inside wall of the housing. When mounting the compressor and motor stator within the housing, axial alignment of the rotor and stator is necessary to provide an adequate air gap therebetween.

Another type of prior art compressor mechanism mounted within a hermetically sealed housing is a scotch yoke compressor comprising a crankcase having a circumferential flange member mountable to the interior wall of the housing. In such an arrangement, a crankshaft with a rotor attached thereto is journalled in axially aligned bearings in the housing. Furthermore, the motor stator is mounted to the crankcase member to facilitate axial alignment of the rotor and stator prior to mounting the compressor mechanism assembly within the housing. However, dynamic operation of the motor during starting and stopping imparts a torque force to the crankcase and mounting flange, which tends to cause relative rotational movement between the crankcase and the housing. It is desirable to avoid such rotational movement between the crankcase and housing due to the fact that, for a direct suction compressor wherein a suction tube extends from the housing to the crankcase, damage may result to the suction tube due to stress placed thereon.

Attempts in prior art rotary compressor assemblies to mount the stator and rotary compressor so as to ensure an accurate air gap between the motor rotor and stator have not proven to be entirely satisfactory. One approach is to weld the circumferential surface of the cylinder block or main bearing flange to the interior wall of the housing. Such an approach initially requires an interference fit between the compressor and the housing, which places stress on both the compressor and the housing, especially when welded together. Furthermore, this approach requires close attention to tolerances and tedious alignment during assembly to ensure the proper air gap.

With respect to prior art attempts to secure a frame member within a housing to prevent rotation therebetween, bolts or screws have been used which extend through the housing members into the frame member. This approach, used primarily in other enclosed devices such as pumps, is not suited for hermetic compressor assemblies wherein a pressurized housing is used. More commonly, the crankcase mounting flange is welded to the housing thereby causing stress. Alternatively, relative rotational movement between the crankcase and housing is prevented by a suction line adapter extending between the crankcase and housing. Where rotational forces are taken up by stress on a suction line adapter, a more expensive, robust adapter must be used.

Problems persist in mounting compressor mechanisms within hermetically sealed housings to provide control of the air gap between the motor stator and rotor during compressor assembly. Furthermore, problems are yet experienced with preventing rotation of a compressor mechanism frame within a housing due to torque forces caused by electric motor operating dynamics. Existing mounting methods, primarily welding, place the housing and compressor frame in tension, thereby causing undesirable stress and noise due to compression and expansion of the compressor housing in response to temperature and pressure variations. Furthermore, it is difficult to achieve a satisfactory circumferential weld between a compressor crankcase mounting flange and the inside wall of the compressor housing.

SUMMARY OF THE INVENTION

The present invention overcomes the disadvantages of the above-described prior art mounting methods for hermetically sealed compressors by providing an improved compressor mounting system for mounting a compressor cylinder block or crankcase within a sealed housing to provide an air gap between the motor stator and rotor and to prevent rotation of the compressor mechanism within the housing.

Generally, the invention provides a hermetically sealed compressor assembly comprising a housing wherein a compressor mechanism, including a frame member, is enclosed therein. An aperture is provided in the sidewall of the housing and a radially outwardly opening hole is provided in the frame member. A pin member is received within the hole and extends radially outwardly through the aperture and is welded thereto.

More specifically, the invention provides, in one form thereof, a mounting apparatus for mounting a compressor mechanism within a housing. In one embodiment of the invention, a plurality of mounting pins received within holes in the compressor mechanism frame extend radially outwardly through oversized aperture in the housing sidewall. The compressor mechanism is properly oriented to provide an air gap between the motor rotor and stator by positioning the pins within the oversized apertures and then welding the pins to the housing when the proper orientation is achieved. In another embodiment of the present invention, a compressor mechanism axially supported in the housing is prevented from rotating by a single pin extending radially outwardly from a hole in the compressor mechanism frame into an aperture in the housing sidewall to which the pin is welded.

An advantage of the structure of the present invention is that a proper air gap between the motor rotor and stator is easily achieved during compressor assembly.

Another advantage of the mounting system of the present invention is that a better weld connection is achieved between the mounting pin and compressor housing than is possible between the compressor crankcase and housing.

A still further advantage of the mounting system of the present invention is that the use of three circumferentially spaced mounting pins does not allow the compressor mechanism to move with respect to the housing.

A still further advantage of the mounting system of the present invention is that rotational movement of the compressor mechanism with respect to the housing is prevented by the use of a single mounting pin, which also prevents binding of the compressor crankcase in the housing which produces undesirable noise.

Another advantage of the mounting system of the present invention is that rotational forces imparted to the compressor mechanism and causing relative rotational movement between the compressor mechanism and the housing are prevented from placing stress on the suction line adapter.

Another advantage of the mounting system of the present invention is that machining tolerances of various compressor assembly components are compensated for in assembly by the provision of a mounting pin selectively positionable within an oversized aperture.

The mounting apparatus of the present invention, in one form thereof, relates to a compressor assembly comprising a compressor mechanism within a hermetically sealed housing having a sidewall, where the compressor mechanism includes a frame member. The invention provides for an aperture in the sidewall, a radially outwardly opening hole in the frame member, a pin member received within the hole and extending radially outwardly substantially through the aperture, and means for attaching the pin member to the housing at the location of the aperture such that the housing remains hermetically sealed.

There is further provided, in one form of the present invention, a hermetically sealed rotary compressor including a cylindrical housing having a sidewall. Provided within the housing is a compressor mechanism having a frame member and an electric motor having a stator secured to the housing. The motor also includes a rotatable rotor operably associated with the stator and separated therefrom by an annular air gap. A crankshaft is rotatably connected to the rotor and is journalled in the frame member. The invention relates specifically to a mounting apparatus for mounting the frame member to the sidewall to provide for the air gap, and comprises a plurality of radially outwardly opening holes in the frame member spaced circumferentially thereabout. Likewise, a plurality of apertures are provided in the sidewall and are spaced circumferentially thereabout, whereby each aperture corresponds to and is substantially aligned with a respective aperture. Furthermore, a plurality of pin members are provided, each being associated with a respective hole and aperture pair. Each pin member is received within the hole and extends radially outwardly through a corresponding aperture. The pin member is shaped and sized to be selectively positioned within the aperture. In this form, the present invention also includes weldment means for attaching the pin members to the housing with the pin members selectively positioned within the aperture such that said air gap is provided. The means for attaching the pin members includes a connection between each one of the pin members and its corresponding aperture about the perimeter thereof such that the housing remains hermetically sealed.

The present invention further provides, in one form thereof, a compressor assembly comprising a hermetically sealed cylindrical housing having a cylindrical sidewall about a vertical main axis. A compressor mechanism within the housing includes a frame member and an electric motor mounted to the frame member. The invention more specifically provides for mounting the compressor mechanism within a housing by an apparatus comprising means for axially supporting the frame member within the housing. Furthermore, means are provided for preventing rotational movement of the frame member with respect to the vertical axis which ordinarily results from torque forces imparted to the frame member by dynamic operation of the motor. The preventing means comprises a pin member received within a hole defined by the frame member and which extends through an aperture in the housing sidewall. The pin member is sealingly connected to the housing at the location of the aperture.

A method of assembling a hermetically sealed rotary compressor is provided according to the present invention, in one form thereof, wherein the compressor includes a housing having a cylindrical sidewall, a compressor mechanism having a frame member and a crankshaft journalled therein. An electric motor is provided having a stator and a rotatable rotor separated one from the other by a desired annular air gap. The rotor is operably coupled to the crankshaft. The method of the present invention, in one form thereof, comprises steps of mounting the stator within the housing and placing the compressor mechanism, together with the rotor operably coupled thereto, within the housing such that the rotor and the stator are separated by the desired annular air gap. A further step is to provide a plurality of apertures in the sidewall of the housing spaced circumferentially thereabout. Another step is to provide a plurality of holes in the frame member, opening radially outwardly at circumferentially spaced locations corresponding to the apertures. Yet another step of the assembly method is to provide a plurality of pin members each having a first frame end and a second housing end. In a further step, the frame end of each one of the pin members is inserted into a respective hole such that the housing end extends radially outwardly into a corresponding aperture in the housing. A welding step is also performed wherein the housing end of each pin member is welded to the housing at the location of a corresponding aperture such that a hermetic seal is maintained for the housing. Accordingly, the compressor mechanism is mounted to the sidewall to achieve a desired air gap between the rotor and the stator.

BRIEF DESCRIPTION

Figure 4:
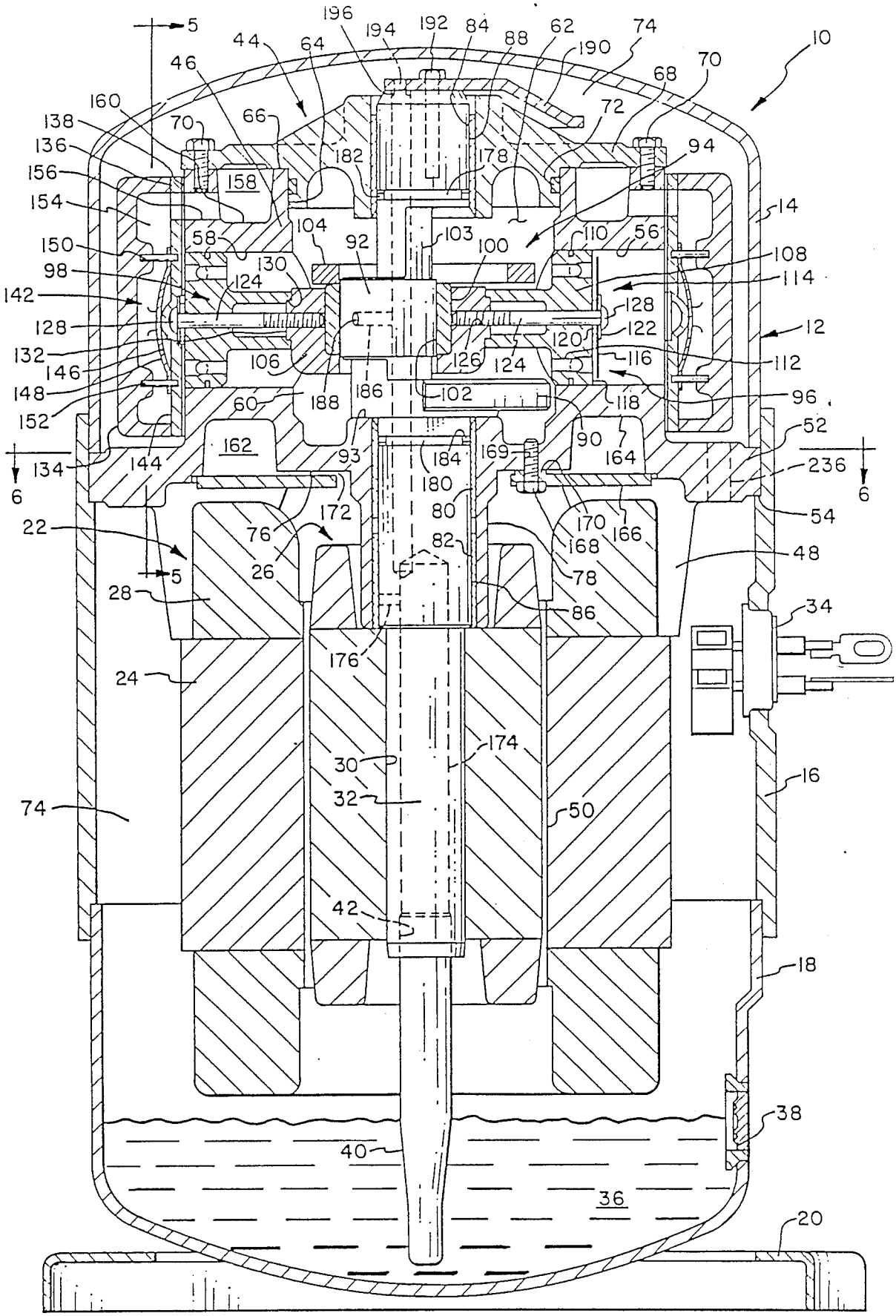
FIG. 4 is a side sectional view of a compressor according to a further embodiment of the present invention.
Figure 6:
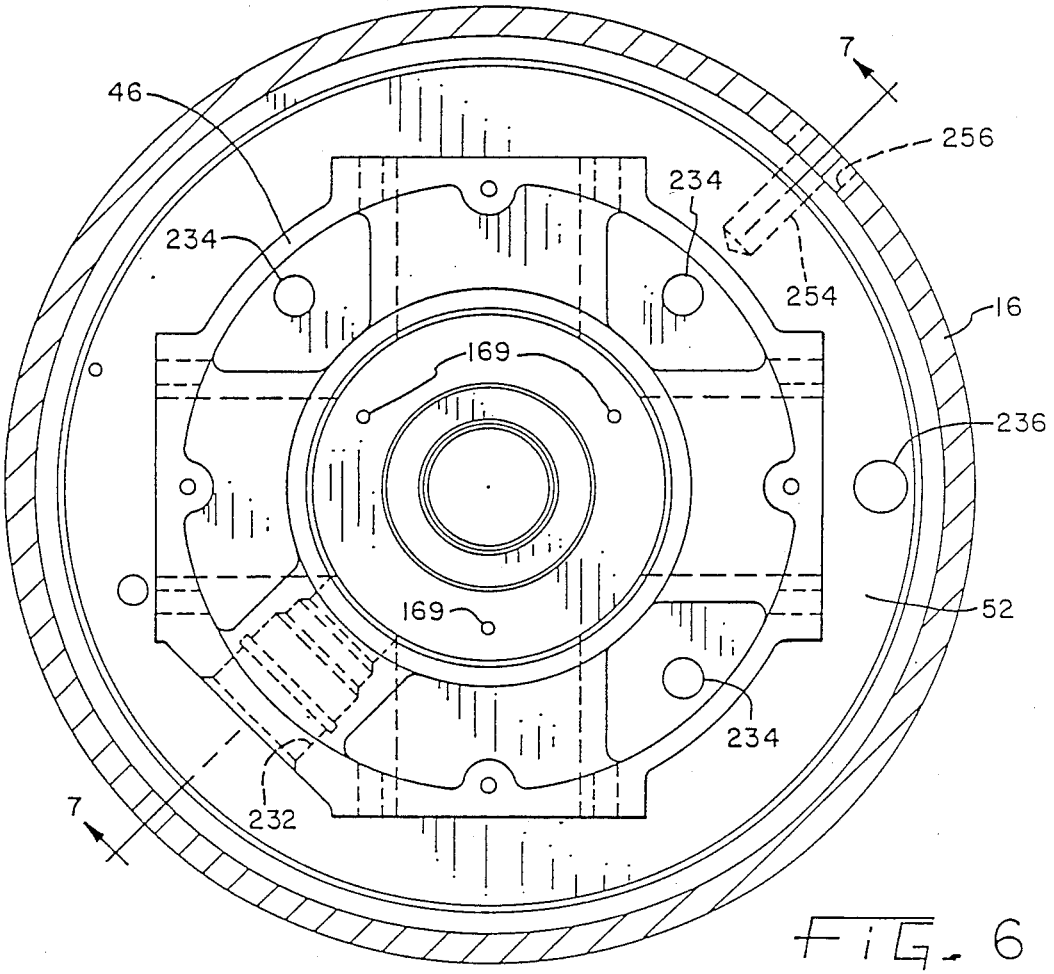
Figure 7:
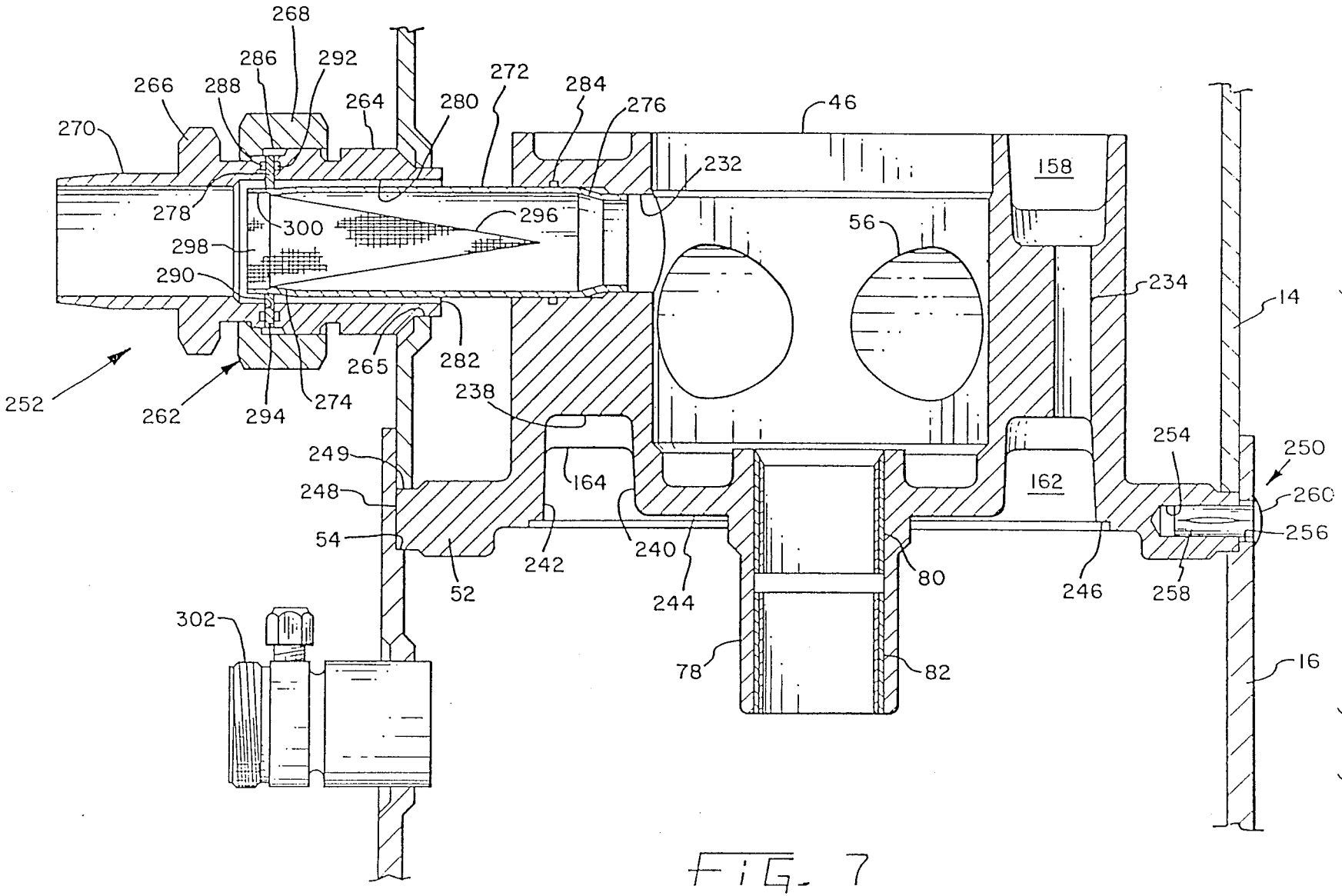

FIG. 6 is a top view of the crankcase of the compressor of FIG. 4, showing a sectional view of the housing taken along the line 6—6 in FIG. 4 and viewed in the direction of the arrows; and FIG. 7 is a fragmentary sectional view of the crankcase and housing assembly of FIG. 6 taken along the line 7—7 in FIG. 6 and viewed in the direction of the arrows, particularly showing a mounting pin assembly in accordance with the present invention.

DESCRIPTION OF THE PREFERRED EMBODIMENT

Figure 1:
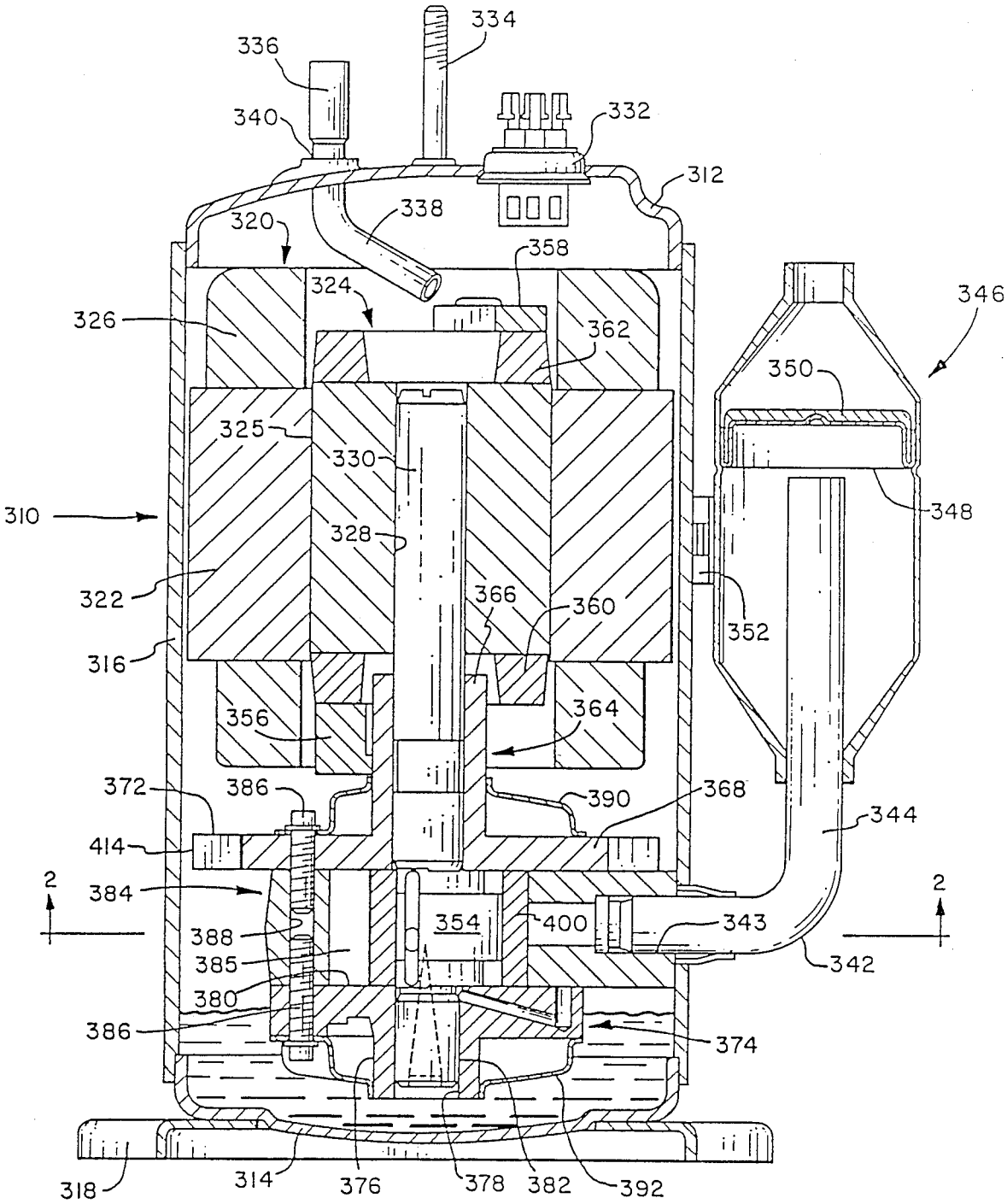
FIG. 1 is a side sectional view of a compressor according to one embodiment of the present invention.

In an exemplary embodiment of the invention as shown in the drawings, and in particular by referring to FIG. 1, a compressor is shown having a housing generally designated at 310. The housing has a top portion 312, a lower portion 314 and a central portion 316. The three housing portions are hermetically secured together as by welding or brazing. A flange 318 is welded to the bottom of housing 310 for mounting the compressor. Located inside the hermetically sealed housing is a motor generally designated at 320 having a stator 322 and a rotor 324 operably spaced from one another by an annular air gap 325. The stator is provided with windings 326. The stator is secured to the housing 310 by an interference fit such as by shrink fitting. The rotor 324 has a central aperture 328 provided therein into which is secured a crankshaft 330 by an interference fit. A terminal cluster 332 is provided on the top portion 312 of the compressor for connecting the compressor to a source of electric power. A post 334 is welded to top portion 312 for mounting a protective cover (not shown) for terminal cluster 332.

A refrigerant discharge tube 336 extends through top portion 312 of the housing and has an end 338 thereof extending into the interior of the compressor as shown. The tube is sealingly connected to housing 310 at 340 as by soldering. Similarly, a suction tube 342 extends into the interior of compressor housing 310 and is sealed thereto as by soldering, brazing, or welding. Suction tube 342 further extends into and is sealingly received within a suction inlet opening 343. The outer end 344 of suction tube 342 is connected to accumulator 346 which has support plates 348 disposed therein for supporting a filtering mesh 350. A bracket 352 secures accumulator 346 to the outside wall of housing 310.

Crankshaft 330 is provided with an eccentric portion 354 which revolves around the crankshaft axis as crankshaft 330 is rotatably driven by rotor 324. Counterweights 356 and 358 are provided to balance eccentric 354 and are secured to respective end rings 360 and 362 of rotor 324 by riveting. Crankshaft 330 is journalled in a main bearing 364 having a cylindrical journal portion 366 and a generally flat planar mounting portion 368 including flanges 372. Planar portion 368 is secured to housing 310 by means of three mounting pin assemblies 370, in accord with the present invention, as will be described in more detail with reference to FIGS. 2 and 3.

A second bearing or journal 374, sometimes referred to as the outboard bearing, is also shown disposed in the lower part of housing 310. Outboard bearing 374 is provided with a journal portion 376 having aperture 378 therein and a generally planar portion 380. Crankshaft 330 has a lower portion 382 journalled in journal portion 376 of outboard bearing 374 as illustrated in FIG. 1.

Located intermediate main bearing 364 and outboard bearing 374 is a compressor cylinder block 384. Cylinder block 384 includes a cylinder therein, referred to herein as compression chamber 385. Compressor cylinder block 384, outboard bearing 374, and main bearing 364 are secured together by means of twelve bolts 386, two of which are indicated in FIG. 1. By referring to FIG. 2, it can be seen that six threaded holes 388 are provided in cylinder block 384 for securing bearings 364, 374 and cylinder block 384 together. Of the twelve bolts 386, six of them secure outboard bearing 374 to cylinder block 384 and are threaded into holes 388. The remaining six bolts secure main bearing 364 to cylinder block 384 and are also threaded into holes 388. An upper discharge muffler plate 390 is secured to main bearing 364 and a lower discharge muffler plate 392 is secured to outboard bearing 374 by bolts 386, as indicated in FIG. 1.

Figure 2:
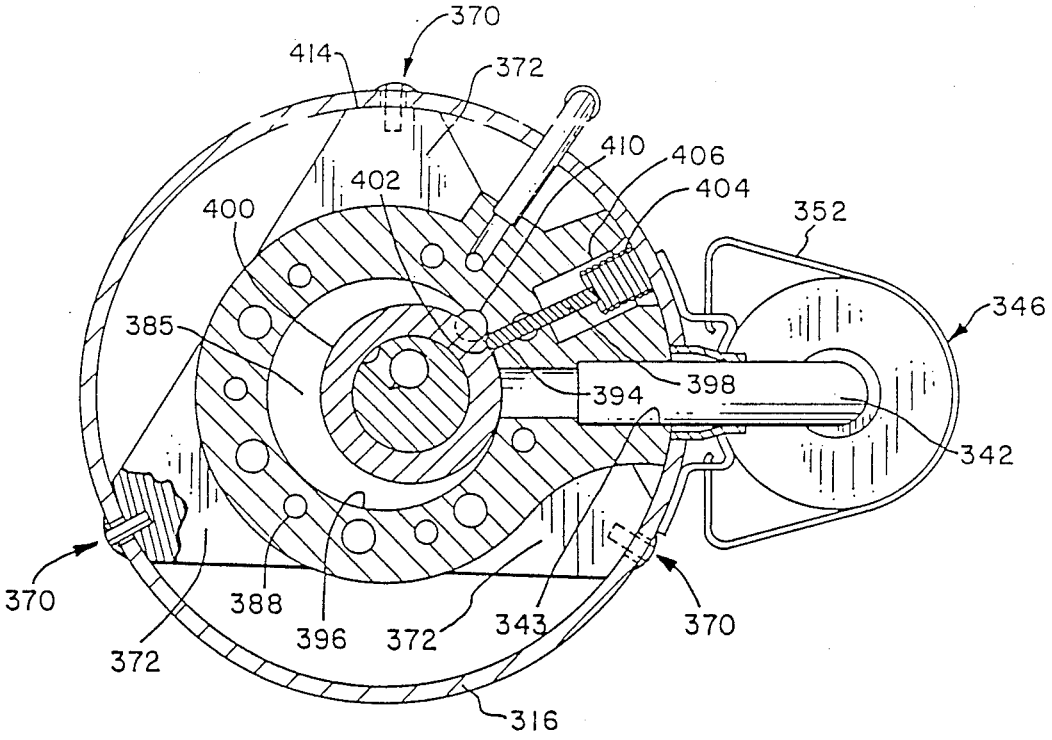
FIG. 2 is a sectional view of the compressor of FIG. 1 taken along the line 2—2 in FIG. 1 and viewed in the direction of the arrows.

By referring to FIGS. 1 and 2 it can be seen that cylinder block 384 has a vane slot 394 provided in the cylindrical sidewall 396 thereof into which is received a sliding vane 398. Roller 400 is provided which surrounds eccentric portion 354 of crankshaft 330 and revolves around the axis of crankshaft 330 and is driven by eccentric 354. Tip 402 of sliding vane 398 is in continuous engagement with roller 400 as vane 398 is urged against the roller by spring 404 received in spring pocket 406. Referring to FIG. 2, during operation, as roller 400 rolls around compression chamber 385, refrigerant will enter chamber 85 through suction tube 342. Next, the compression volume enclosed by roller 400, cylinder wall 396, and sliding vane 398 will decrease in size as roller 400 revolves clockwise around compression chamber 385. Refrigerant contained in that volume will therefore be compressed and after compression will exit through a relief 410 in sidewall 396.

A discharge muffling system is provided in the embodiment of FIGS. 1 and 2, whereby compressed gas exiting through relief 410 passes through main bearing 364 and outboard bearing 374 into mufflers defined by upper muffler plate 390 and lower muffler 392, respectively. The gas from the mufflers is then discharged into the interior of housing 310.

Figure 3:
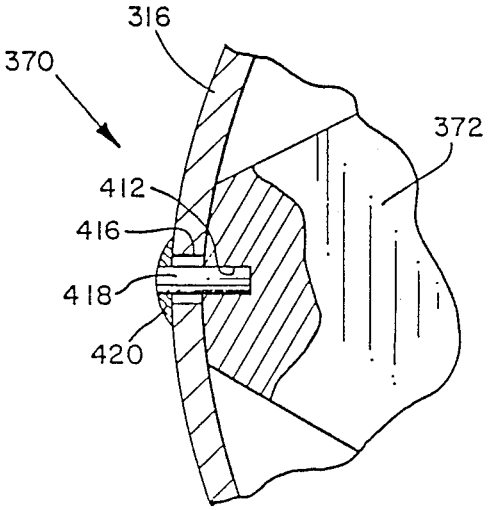
FIG. 3 is an enlarged fragmentary view of the compressor of FIGS. 1 and 2 particularly showing a mounting pin assembly in accord with the present invention.

Reference will now be made to FIGS. 2 and 3 for a more detailed description of the mounting pin assemblies 370 in accord with the present invention. Specifically, flanges 372 are provided with radially outwardly opening holes 412 in a radially outward facing flange surface 414. Corresponding apertures 416 are provided in central portion 316 of housing 310 such that holes 412 and respective apertures 416 are substantially axially aligned. A scroll pin 418 is frictionally slidably engaged within each hole 412 and extends radially outwardly into a corresponding aligned aperture 416.

In a preferred embodiment, aperture 416 is oversized with respect to the diameter of scroll pin 418 to allow for selective positioning of scroll pin 418 within aperture 416. Specifically, an annular clearance of 0.030 is provided where the diameter of the pin is $\frac{3}{8}$ inches and the diameter of the aperture is 7/16 inches. Accordingly, the rotary compressor within housing 310 is selectively positioned and mounted to achieve a proper air gap 325 between rotor 324 and stator 320. When properly positioned, scroll pins 418 are attached, as by welding, to central portion 316 of the housing, as indicated in FIG. 2 by weldment 420. Weldment 420 extends between scroll pin 418 and central portion 316 at the location of aperture 416, to ensure that housing 310 remains hermetically sealed. It is appreciated that weldment 420 may alternatively take the form of brazing, epoxy, or the like, without departing from the spirit and scope of the present invention.

Scroll pin 418, as defined herein, comprises a spirally wound band of cold rolled steel, or the like. While such a wound, cylindrical pin exhibits superior welding properties in the present application, it is appreciated that other pins may be used without departing from the scope of the present invention. Furthermore, the disclosed preferred embodiment of the present invention provides three equally circumferentially spaced mounting pin assemblies 370 for mounting the compressor mechanism within the housing. In such an arrangement the compressor mechanism is restrained against movement, while the housing is permitted to radially expand and contract in response to varying housing temperature and pressure conditions.

The present invention also contemplates a method for assembling a rotary compressor within a housing to ensure a desired annular air gap between a motor stator and rotor. More specifically, with reference to FIGS. 1–3, the method of the present invention comprises mounting stator 322 within central portion 316 as by a friction fit. The rotary compressor mechanism, together with rotor 324 coupled thereto, is then inserted into the housing such that the rotor and stator are separated by a desired annular air gap. The desired air gap may be maintained during assembly by means of a locating pin temporarily received within suction inlet opening 343, and a gap collar, such as a thin cylindrical metal shell located between the rotor and stator. A plurality of circumferentially spaced apertures 416 are provided in the sidewall of central portion 316. The method also includes the provision of a plurality of holes 412 in main bearing 364 such that the holes open radially outwardly at circumferentially spaced locations corresponding to apertures 416. Holes 412 and apertures 416 are generally aligned when the rotary compressor is in proper position within the housing. Scroll pins 418 are then inserted through apertures 416 into holes 412, with a portion of the pin remaining within aperture 416 or protruding slightly therefrom. After the compressor mechanism is selectively positioned to achieve the desired annular air gap, pins 418 are welded to central portion 316 of the housing so as to provide a hermetic seal to the housing.

In an alternative embodiment of the present invention as shown in FIGS. 4–7, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment of FIG. 4, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. A bore 236 extends through flange 52 to provide communication between the top and bottom ends of housing 12 for return of lubricating oil and equalization of discharge pressure within the entire housing interior. The mounting of crankcase 46 within housing 12, in accord with the alternative embodiment of the present invention, will be described in further detail with particular reference made to FIGS. 5–7.

Compressor mechanism 44, as illustrated in the embodiment of FIG. 4, takes the form of a reciprocating piston, scotch yoke compressor. More specifically, crankcase 46 includes four radially disposed cylinders, two of which are shown in FIG. 4 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

A sleeve bearing, as referred to herein, is defined as a generally cylindrical bearing surrounding and providing radial support to a cylindrical portion of a crankshaft, as opposed to a thrust bearing which provides axial support for the weight of the crankshaft and associated parts. A sleeve bearing, for example, may comprise a steel-backed bronze sleeve insertable into a crankcase, or a machined cylindrical surface made directly in the crankcase casting or another frame member.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 4, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the alternative embodiment of FIG. 4, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 4 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 4. Suction valve assembly 116 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 4, valve retainer 122, suction valve 116, and guide member 120 are secured to top surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gaseous refrigerant within each cylinder is discharged through discharge ports in a valve plate. With reference to cylinder 58 in FIG. 4, a cylinder head cover 134 is mounted to crankcase 46 with a valve plate 136 interposed therebetween. A valve plate gasket 138 is provided between valve plate 136 and crankcase 46. Valve plate 136 includes a coined recess 140 into which buttonhead 128 of threaded bolt 124 is received when piston assembly 98 is positioned at top dead center (TDC).

A discharge valve assembly 142 is situated on a top surface 144 of valve plate 136. Generally, compressed gaseous refrigerant is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Figure 5:
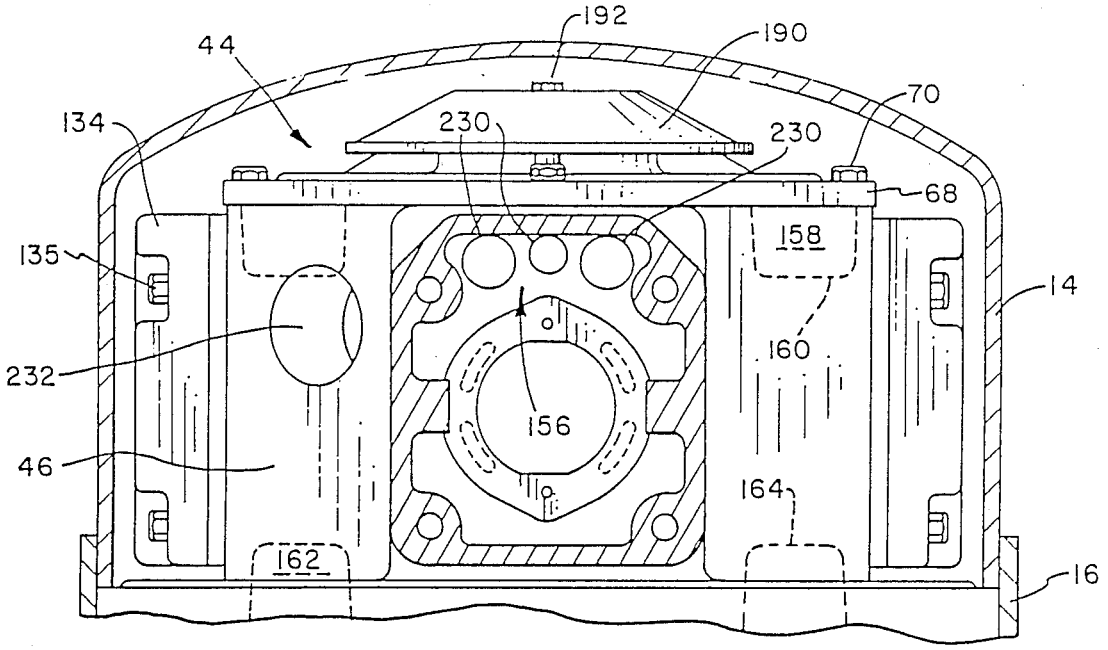
FIG. 5 is a fragmentary sectional view of the compressor of FIG. 4 taken along the line 5—5 in FIG. 4 and viewed in the direction of the arrows.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts 135, shown in FIG. 5. Discharge gas within discharge space 154 associated with each respective cylinder passes through a respective connecting passage 156, thereby providing communication between discharge space 154 and a top annular muffling chamber 158. As illustrated in FIG. 5, passage 156 may comprise a plurality of bores 230. Chamber 158 is defined by an annular channel 160 formed in top surface 66 of crankcase 46, and cage bearing 68. As illustrated, connecting passage 156 passes not only through crankcase 46, but also through holes in valve plate 136 and valve plate gasket 138.

Top muffling chamber 158 communicates with a bottom muffling chamber 162 by means of passageways 234 extending through crankcase 46. Chamber 162 is defined by an annular channel 164 and a muffler cover plate 166. Annular channel 164 comprises a bottom wall 238, a radially inner sidewall 240, and a radially outer sidewall 242. Cover plate 166 is mounted against a radially inner ledge 244 of bottom surface 76 at a plurality of circumferentially spaced locations by bolts 168 and threaded holes 169 (FIG. 6). Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172. The radially outward extreme portion of cover plate 166 is biased in engagement with a radially outer ledge 246 of bottom surface 76 to prevent escape of discharge gas from within bottom muffling chamber 162 at this radially outward location.

Compressor assembly 10 of FIG. 4 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 4, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Specific reference will now be made to FIGS. 6 and 7 for a more detailed description of the mounting pin assembly of the alternative embodiment, whereby rotational movement of crankcase 46 within housing 12 is prevented. As previously described, mounting flange 52 is axially supported within annular ledge 54. The outside diameter of flange 52 is spaced slightly, i.e., 0.005–0.010 inches, from central portion 16 at annulus 248 to prevent binding when expansion and contraction of the housing occurs due to pressure and temperature conditions. Also, there is planar contact between top portion 14 and flange 52 at 249, or perhaps a few thousandths of an inch clearance. Preferably, a clamping force at 249 is avoided so as to reduce stresses and associated noise.

In the alternative embodiment of the present invention, a single mounting pin assembly 250 is provided diametrically opposed from a suction fitting assembly 252. Mounting pin assembly 250 comprises a radially outwardly opening hole 254 in flange 52. An aperture 256 in substantial alignment with hole 254 is provided in central portion 16 of the housing. A notched pin 258 is frictionally engaged within hole 254 and extends into aperture 256. A connection is made between pin 258 and central portion 16 at aperture 256, represented in FIG. 4 by weldment 260. As previously discussed with respect to weldment 420 in FIG. 3, weldment 260 may alternatively comprise brazing material, epoxy, or the like. By spacing pin assembly 250 and fitting assembly 252 diametrically opposite one another, any movement of the crankcase relative to the housing is promoted along the axis of the fitting to prevent damage thereto.

Referring now to suction fitting assembly 252, there is provided a housing fitting assembly 262 comprising a housing fitting member 264, a removable outer fitting member 266, and a threaded nut 268. Housing fitting member 264 is received within an aperture 265 in top portion 14 of the housing, and is sealingly attached thereto as by welding, brazing, soldering, or the like. Outer member 266 includes a nipple 270 over which suction tubing of a refrigeration system may be received and brazed or soldered thereto. Threaded nut 268 is rotatable, yet axially retained, on outer fitting member 266.

Suction fitting assembly 252 further includes a suction tube insert 272 comprising a short length of cylindrical tubing having a first end 274 and a second end 276. A ringlike flange 278, such as a washer, is secured to the outside diameter of end 274 and extends radially outwardly therefrom. Flange 278 is secured to end 274 by means of brazing or welding. Housing fitting assembly 262, and particularly housing member 264 and outer member 266, define a fitting bore 280 in which suction tube insert 272 axially resides. More specifically, the diameter of insert 272 is less than the diameter of bore 280 such that an annular clearance 282 is provided therebetween. In the preferred embodiment, clearance 282 is 0.050 inches circumferentially about insert 272.

During the design and manufacture of the compressor of the disclosed embodiment, it is anticipated that suction inlet opening 232 and fitting bore 280 will be axially aligned to permit extension of suction tube insert 272 therebetween. Specifically, second end 276 of insert 272 is sealingly slidably engaged within opening 232, as by a slip fit. An annular seal 284 is provided in the sidewall of opening 232 so that tube insert 272 may be inserted a selective depth into opening 232 while maintaining a proper seal. In this way, variations in radial spacing between crankcase 46 and central portion 14 of the housing may be compensated for.

With respect to rotational alignment of crankcase 46 such that tube insert 272 is axially received within fitting bore 280, mounting pin assembly 250 provides for a limited degree of rotational alignment. Compensation for misalignment between suction inlet opening 232 and fitting bore 280 along the axial direction with respect to compressor housing 12 is provided by the disclosed structure whereby flange 278 is retained within fitting bore 280. Flange 278 extends radially outwardly from insert 272 and is received between outer fitting member 266 and housing fitting member 264. Furthermore, an annular space 286 is provided between the outside diameter of flange 278 and the inside diameter of threaded nut 268. The combination of annular space 286 and annular clearance 282 permits random movement of tube insert 272 within bore 280, whereby the axis of insert tube 272 is substantially parallel to and selectively spaced relative to the axis of fitting bore 280. This freedom of motion of tube insert 272 within fitting bore 280 translates to approximately .100 inches of compensation for misalignment of suction inlet opening 232 and fitting bore 280 along the vertical axis of the housing.

Suction fitting 252 provides a sealing arrangement whereby flange 278 is sealingly retained between housing fitting member 264 and outer fitting member 266. Specifically, an annular sealing ring 288 is interposed between sealing surface 290 of outer member 266, and flange 278. Likewise, an annular sealing ring 292 is interposed between a sealing surface 294 of housing member 264, and flange 278. In the preferred embodiment, annular sealing rings 288, 292 are retained within grooves in sealing surfaces 290, 294, respectively. Accordingly, flange 278 is sealingly secured between housing fitting member 264 and outer fitting member 266 when threaded nut 268 draws the two members together.

The disclosed suction fitting assembly further comprises a conical screen filter 296 including a mounting ring 298 at the base end thereof. Mounting ring 298 slip fits into a counterbore 300 provided in first end 274 of suction tube insert 272. In such an arrangement, filter 296 may be easily removed for cleaning or replacement.

FIG. 7 also shows a discharge fitting 302 provided in central portion 16 of housing 12 located directly beneath suction fitting assembly 252. The location of discharge fitting 302 in a central or lower portion of the housing provides an advantage in that the fitting acts as a dam and limits to about 20 lbs. the amount of refrigerant charge that will be retained by the compressor and required to be pumped out upon startup.

It will be appreciated that the foregoing is presented by way of illustration only, and not by way of any limitation, and that various alternatives and modifications may be made to the illustrated embodiment without departing from the spirit and scope of the invention.

What is claimed is:

1. In a compressor assembly comprising a compressor mechanism within a hermetically sealed housing having a sidewall, said compressor mechanism including a frame member, mounting apparatus for mounting said frame member to said sidewall, comprising:

an aperture in said sidewall;

a radially outwardly opening hole in said frame member;

a pin member slidably received within said hole and extending radially outwardly substantially through said aperture; and means for fixedly attaching said pin member to said housing; at the location of said aperture such that said housing remaining hermetically sealed, whereby, as a result of said pin member sliding within said hole; said housing sidewall is permit-ed to expand and contract radially relative to said frame member in response to varying housing temperature and pressure conditions.

2. The mounting apparatus of claim 1 in which:

said pin member is substantially cylindrical and said aperture is substantially round, said pin member having a diameter less than the diameter of said aperture to provide an annular space therebetween.

3. The mounting apparatus of claim 2 in which:

said means for attaching comprises a weld between said pin member and said sidewall adjacent said aperture, said weld extending across said annular space to provide a seal.

4. The mounting apparatus of claim 1 in which a clearance is permitted between said frame and said sidewall, whereby said pin bridges said clearance to mount said frame to said sidewall.

5. The mounting apparatus of claim 1 in which said pin member is slidably received within said hole.

6. The mounting apparatus of claim 1 in which said pin member is frictionally slidably engaged within said hole.

7. In a hermetically sealed rotary compressor including a cylindrical housing having a sidewall, a compressor mechanism within said housing including a frame member, an electric motor within said housing having a stator secured to said housing and a rotatable rotor operably associated with said stator and separated therefrom by an annular air gap, and a crankshaft rotatably connected to said rotor and journalled in said frame member, mounting apparatus for mounting said frame member to said sidewall to provide for said air gap, comprising:

a plurality of radially outwardly opening holes in said frame member spaced circumferentially thereabout;

a plurality of apertures in said sidewall spaced circumferentially thereabout, each one of said plurality of apertures corresponding to and being substantially aligned with a respective one of said plurality of apertures;

a plurality of pin members respectively associated with said plurality of corresponding holes and apertures, each pin member being received within one of said holes and extending radially outwardly substantially through a corresponding one of said apertures, said pin members being shaped and sized to be selectively positioned within said apertures; and means for attaching said pin members to said housing with said pin members selectively positioned within said apertures such that said air gap is provided., said means comprising a connection between each one of said pin members and respective one of said apertures about the perimeter thereof such that said housing remains hermetically sealed.

8. The mounting apparatus of claim 7 in which:

said means for attaching said pin members to said housing comprises a weld between each one of said pin members and a respective one of said apertures.

9. The mounting apparatus of claim 7 in which:

said plurality of holes comprises three holes substantially equally spaced circumferentially about said frame member.

10. The mounting apparatus of claim 7 in which:

each of said plurality of pin members is substantially cylindrical and each of said plurality of apertures is substantially round, each said pin member having a diameter less than the diameter of a corresponding said aperture to provide an annular space therebetween.

11. The mounting apparatus of claim 7 in which said frame member is spaced from said sidewall.

12. The mounting apparatus of claim 7 in which:

each of said plurality of pin members comprises a substantially cylindrical scroll pin, each said scroll pin being frictionally slidably received within a corresponding one of said plurality of holes.

13. In a compressor assembly comprising a hermetically sealed cylindrical housing having a cylindrical sidewall about a vertical main axis, and a compressor mechanism within said housing including a frame member and an electric motor mounted to said frame member, apparatus for mounting said compressor mechanism within said housing, comprising:

means for axially supporting said frame member within said housing; and, means for preventing rotational movement of said frame member with respect to said vertical axis resulting from torque forces imparted to said frame member by dynamic operation of said motor, said preventing means comprising a pin member slidably received within a hole defined by said frame member and extending through an aperture in said housing sidewall, said pin member being sealingly connected to said housing at the location of said aperture, whereby, as a result of said pin member sliding within said hole, said housing sidewall is permitted to expand and contract radially relative to said frame member in response to varying housing temperature and pressure conditions.

14. The mounting apparatus of claim 13 in which:

said pin member is welded to said housing at the location of said aperture.

15. The mounting apparatus of claim 13 in which:

said supporting means includes a horizontal annular ledge associated with said cylindrical sidewall, on which said frame member rests.

16. The mounting apparatus of claim 13 in which:

said frame member includes a radially extending mounting flange spaced slightly radially inwardly of said sidewall.

17. The mounting apparatus of claim 13 in which said pin member is frictionally slidably received within said hole.

18. The mounting apparatus of claim 13, and further comprising:

a suction inlet tube extending radially outwardly from said frame through said housing, said inlet tube extending through said sidewall at a location diametrically opposite the location of said aperture.

19. A method of assembling a hermetically sealed rotary compressor including a housing having a cylindrical sidewall, a compressor mechanism having a frame member and a crankshaft journalled therein, and an electric motor having a stator and a rotatable rotor separated one from the other by a desired annular air gap, said rotor being operably coupled to said crankshaft, comprising the steps of:

mounting said stator within said housing;

placing said compressor mechanism, together with said rotor operably coupled thereto, within said housing such that said rotor and said stator are separated by the desired annular air gap;

providing a plurality of apertures in said sidewall spaced circumferentially thereabout;

providing a plurality of holes in said frame member opening radially outwardly at circumferentially spaced locations corresponding to said apertures;

providing a plurality of pin members each having a first frame end and a second housing end;

inserting the frame end of each one of said plurality of pin members into a respective one of said plurality of holes such that said housing end extends radially outwardly into a corresponding one of said plurality of apertures; and, attaching the housing end of each one of said plurality of pin members to said housing at the location of a corresponding one of said plurality of apertures such that a hermetic seal is maintained for said housing, whereby said compressor mechanism is mounted to said sidewall to achieve a desired air gap between said rotor and said stator.

20. The method of assembling a compressor of claim 19 in which:

said attaching step is by welding the housing end of each one of said plurality of pin members to said housing.

21. The method of assembling a compressor of claim 19 in which:

said step of providing a plurality of pin member is by providing a plurality of substantially cylindrical scroll pins.

22. The method of assembling a compressor of claim 19 in which:

said inserting step is by frictionally slidably inserting said plurality of pins into said plurality of holes.

23. The method of assembling a compressor of claim 19 in which:

said steps of providing a plurality of apertures and providing a plurality of pin members are by providing pin members wherein said housing ends thereof have diameters substantially less than the diameter of said apertures; and said step of placing said compressor mechanism within said housing to achieve the desired annular air gap is by selectively positioning said housing ends of said plurality of pin members within respective said plurality of apertures.

* * * * *

UNITED STATES PATENT AND TRADEMARK OFFICE

CERTIFICATE OF CORRECTION

PATENT NO. : 4,846,635

DATED : July 11, 1989

INVENTOR(S) : Emanuel D. Fry et al

It is certified that error appears in the above-identified patent and that said Letters Patent is hereby corrected as shown below:

Claim 1, Col. 13, line 22, change "remaining" to --remains--;

Claim 11, Col. 14, lines 28 and 29, delete "said frame member is spaced from said sidewall." and insert therefor;

--a clearance is permitted between said frame and said sidewall, whereby said pin bridges said clearance to mount said frame to said sidewall.--

Signed and Sealed this

Twenty-fourth Day of April, 1990

*Attest:*

HARRY F. MANBECK, JR.

*Attesting Officer*

*Commissioner of Patents and Trademarks*